United States Patent [19]

Kerester

[11] 4,411,108

[45] Oct. 25, 1983

[54] GUTTER SYSTEM

[76] Inventor: Thomas P. Kerester, 1305 Kingston Ave., Alexandria, Va. 22302

[21] Appl. No.: 281,383

[22] Filed: Jul. 8, 1981

[51] Int. Cl.[3] ..... E04D 13/06

[52] U.S. Cl. ..... 52/11; 248/48.2; 405/119

[58] Field of Search ..... 52/11, 12, 15, 16; 248/48.1, 48.2; 405/119

[56] References Cited

U.S. PATENT DOCUMENTS

| | | | |
|---|---|---|---|
| 538,108 | 4/1895 | Freeze . | |
| 1,141,204 | 6/1915 | Noce . | |
| 2,720,409 | 10/1955 | Griffith . | |
| 3,077,055 | 2/1963 | Tripp | 52/12 |
| 3,091,055 | 5/1963 | Hegedusich . | |
| 3,292,198 | 12/1966 | Perkel . | |
| 3,740,787 | 6/1973 | Bowermaster . | |
| 4,019,290 | 4/1977 | Manty . | |
| 4,061,151 | 12/1977 | Ward . | |
| 4,072,285 | 2/1978 | Greenwood . | |
| 4,116,008 | 9/1978 | Ward . | |
| 4,117,635 | 10/1978 | Nelson . | |
| 4,199,121 | 4/1980 | LeFebvre . | |

*Primary Examiner*—John E. Murtagh
*Assistant Examiner*—Kathryn L. Ford
*Attorney, Agent, or Firm*—Schuyler, Banner, Birch, McKie & Beckett

[57] ABSTRACT

A rotatable gutter system including a longitudinally elongated gutter, a plurality of supports and a pulley and cable drive mechanism is disclosed. The support may be attached to the facia board of a building, or the underside of an eave. Each support includes a support bracket for attachment to the building and a gutter support member having roller bearings. The support member is attached to the gutter. The gutter can be rotated into a substantially inverted position for emptying debris therefrom by a cable actuated pulley affixed to one end of the gutter. A specially designed downspout having a gutter receiving aperture permits unhampered rotation of the gutter.

23 Claims, 4 Drawing Figures

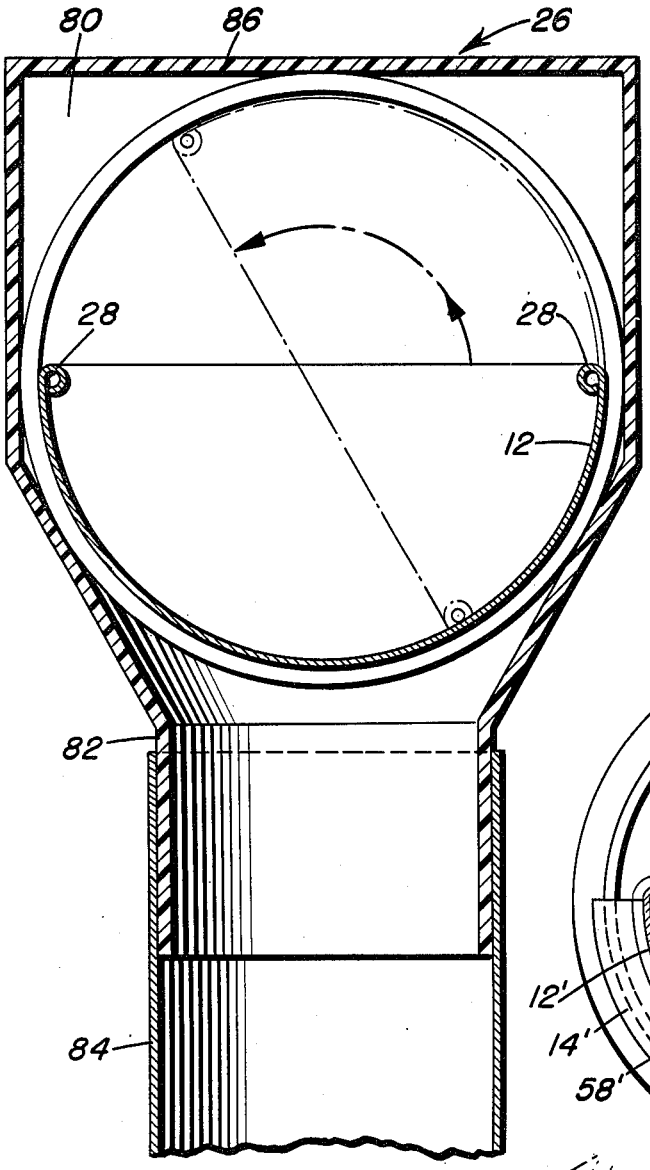
FIG. 4
FIG. 5
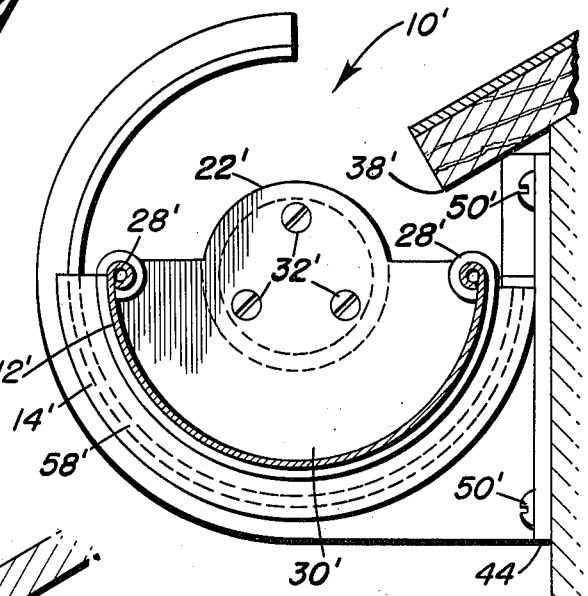
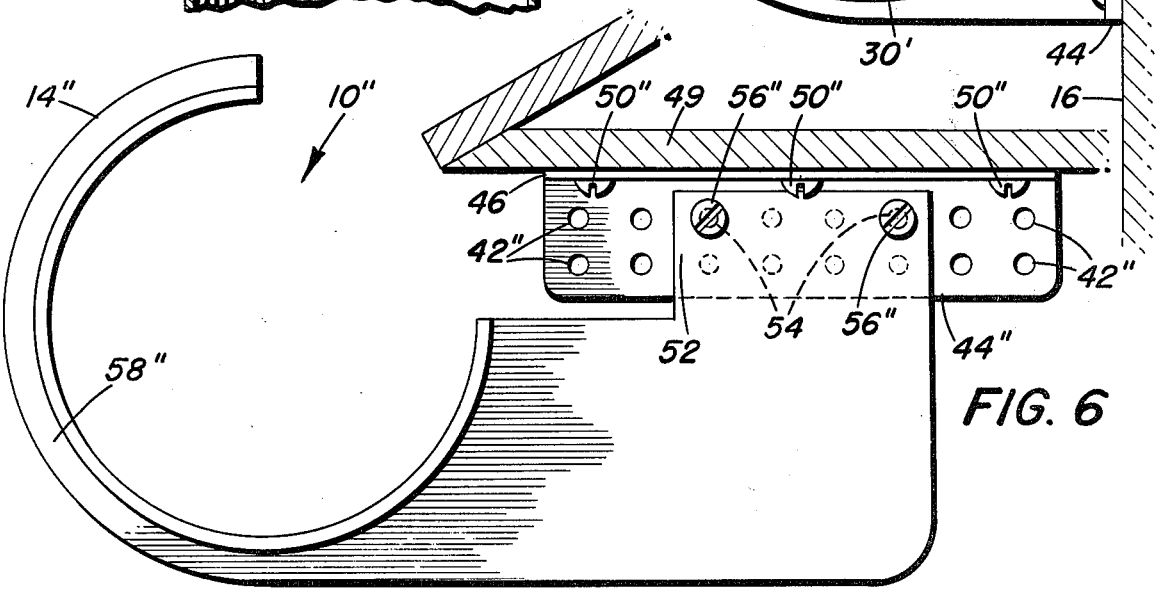
FIG. 6

GUTTER SYSTEM

BACKGROUND OF THE INVENTION

1. Field of the Invention

The present invention relates to a gutter system for a building which permits the gutter to be substantially inverted to facilitate emptying of debris from the gutter.

2. Description of the Prior Art

Rain gutters are employed to catch water runoff from roofs, particularly roofs of houses, to prevent erosion of the soil adjacent the building walls and structual damage to the foundation. Debris that may accumulate on the roof of a building, most commonly leaves, is washed into the gutters by rainwater, where it often clogs the gutter system. Removal of such accumulated debris is necessary to restore proper drainage. Such removal is tedious, time consuming, and often dangerous. Home owners and others, all too frequently attempt to clean gutter systems while precariously balanced on long ladders.

Various attempts to eliminate the invonvenience and danger involved in cleaning gutters have been made. For example, screens can be placed over the gutter. Screens prevent much debris from entering the gutter; however, the screens themselves become clogged requiring essentially the same cleaning chore. To overcome this difficulty, various prior art gutter systems have been devised that permit rotation of the gutter into an inverted or substantially inverted position to permit debris to be dislodged and to fall from the gutter to the ground. Such gutter systems are disclosed in U.S. Pat. Nos. 1,141,204 and 4,019,290. The systems disclosed in these patents require a long piano hinge that runs the entire length of the gutter. The hinges of such gutters may be subject to corrosion which would interfere with rotation of the gutter. In addition, neither of the gutter systems illustrated in these patents makes any provision for downspouts. U.S. Pat. No. 4,072,285 discloses a gutter system which uses a pivoting rod that runs the length of the gutter in place of a piano hinge.

U.S. Pat. Nos. 4,061,151; 4,116,008; and 4,117,635 all disclose more complex systems for inverting gutters for cleaning. Each involves complicated mechanisms that are relatively difficult and expensive to manufacture, such as a ratchet gearbox for driving the inverting mechanism.

Therefore, a significant need exists for a dumpable gutter that is reliable, relatively simple and inexpensive to manufacture, requires minimal maintenance, is relatively easy to install, and may be easily and safely emptied of debris by an operator standing on the ground.

SUMMARY OF THE INVENTION

Accordingly, it is an object of the present invention to provide a gutter system that eliminates the danger and much of the tedium involved in cleaning gutters.

Another object of the invention is to provide a gutter that can be easily cleaned by substantially inverting the gutter.

Another object of the invention is to provide a gutter that can be cleaned easily by an operator standing on the ground.

Another object of the present invention is to provide a dumpable gutter which is simple and economical to manufacture and is easily installed.

Another object of the invention is to provide a dumpable gutter that does not require lengthy supporting rods or hinges.

Another object of the invention is to provide a dumpable gutter system that includes downspouts which do not interfere with inversion of the gutter.

These and other objects are achieved by providing a gutter system comprising: a gutter; a support bracket for attachment to a building, the bracket having a curvilinear bearing surface support member attached to the gutter, and roller means carried by either the support member or the support bracket for rolling contact between the support member and the support bracket whereby said support member is supported by said bracket and is movable relative to said bracket to rotate the gutter for the removal of debris; and means actuatable from the ground for rotating the gutter.

The invention may be best understood by referring to the following detailed description and accompanying drawings which illustrate the invention.

BRIEF DESCRIPTION OF THE DRAWINGS

FIG. 4 is a cross-sectional view taken along line 4—4 of FIG. 1;

FIG. 5 is a cross-sectional view illustrating the gutter system of the present invention attached along roof line by a second embodiment of support bracket;

FIG. 6 is a cross-sectional view illustrating the gutter system of the present invention attached along roof line by a third embodiment of support bracket.

DETAILED DESCRIPTION OF THE PREFERRED EMBODIMENTS

Figure 1:
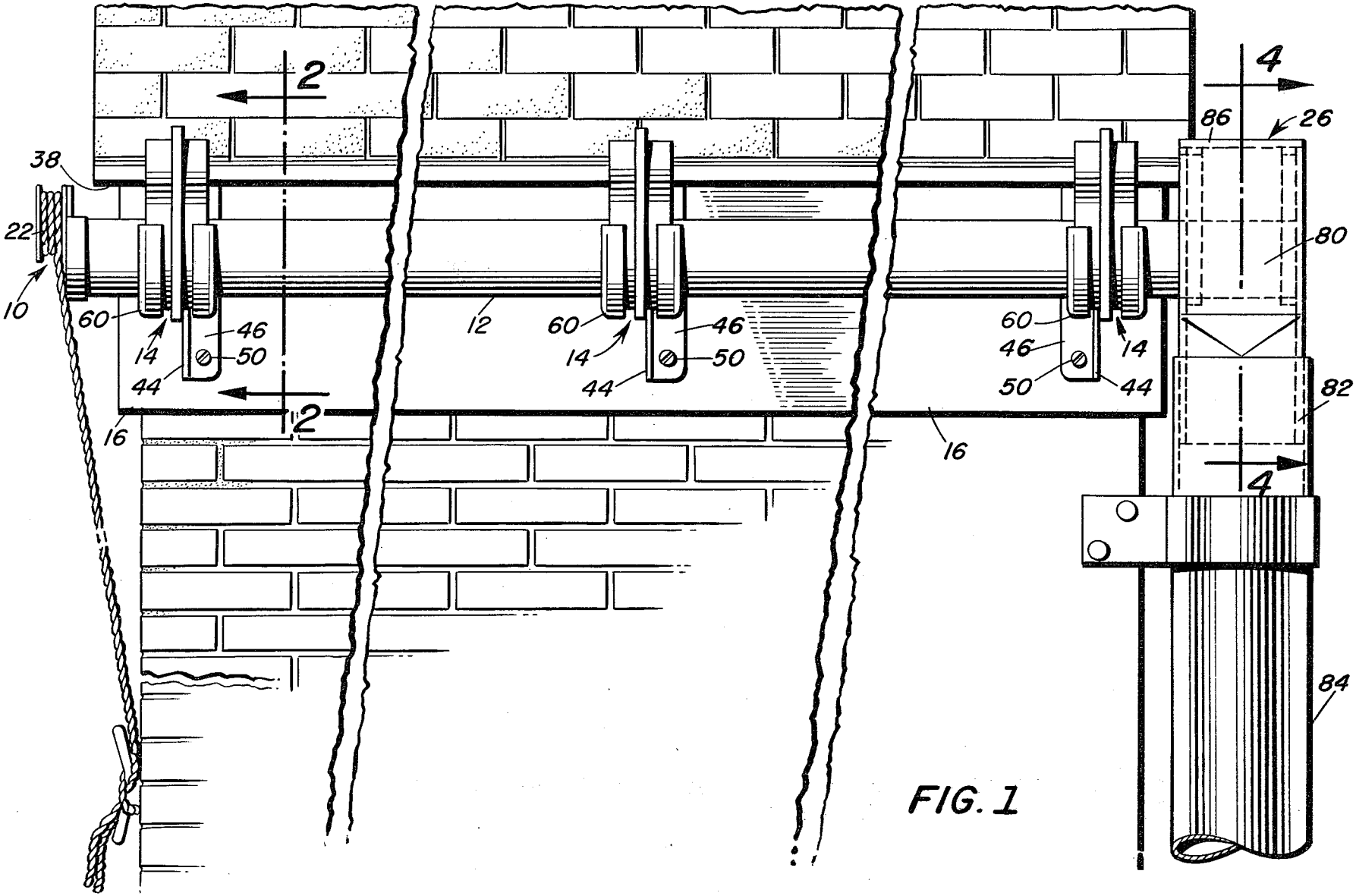
FIG. 1 is a side elevation of a gutter and downspout system according to the present invention shown attached to a building.

Referring to FIG. 1, the dumpable gutter system 10 includes an elongated gutter 12 which nests in a plurality of supports 14 attached to facia board 16 of building 18. A pulley 22 is fixedly attached to one end of gutter 12. A cable 24 is wraped around pulley 22. The other end of the gutter 12 extends into a downspout 26 which is specially designed to permit drainage of gutter 12 without hindering rotation of gutter 12 for cleaning.

The gutter 12 may have a semicircular cross-section and include rolled edges 28, however, gutter 12 may have any conventional cross-sectional configuration which can be held by the support brackets 14. Gutter 12 is elongated and may be manufactured in any convenient length. Multiple sections can be joined by a conventional coupling mechanism, not shown, when necessary to span the full length of a roof line. Gutter 12 may be constructed of any suitable convenient material, such as galvanized sheet metal or plastic. One end of gutter 12 is closed by end piece 30 which is attached perpendicular to the longitudinal axis of gutter 12 by any suitable means of attachment, such as welding or gluing. End piece 30 includes a semicircular portion extending above the plane of the top of gutter 12. Pulley 22 is fixedly attached to end piece 30 by suitable fasteners, such as nuts and bolts 32 so that pulley 22 and gutter 12 are immovable relative to one another. Cable 24 forms one or more loops about pulley 22 and has sufficient length to extend adjacent the ground where it is attached to anchor 34. Cable 24 therefore can be easily grasped by a person standing on the ground.

Figure 2:
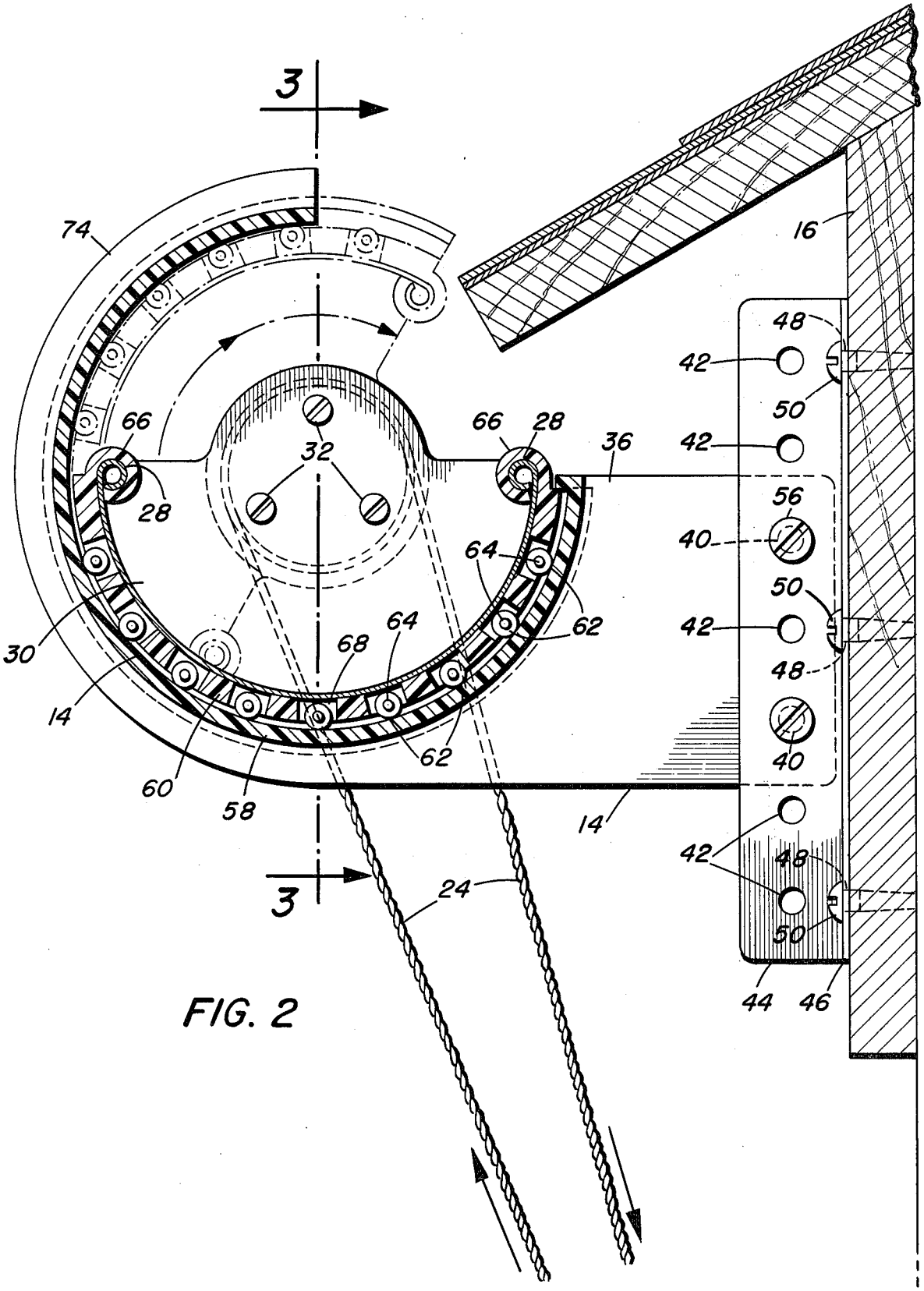
FIG. 2 is a cross-sectional view of the gutter system taken along line 2—2 of FIG. 1, with a portion of the support member and bracket also in section.
Figure 3:
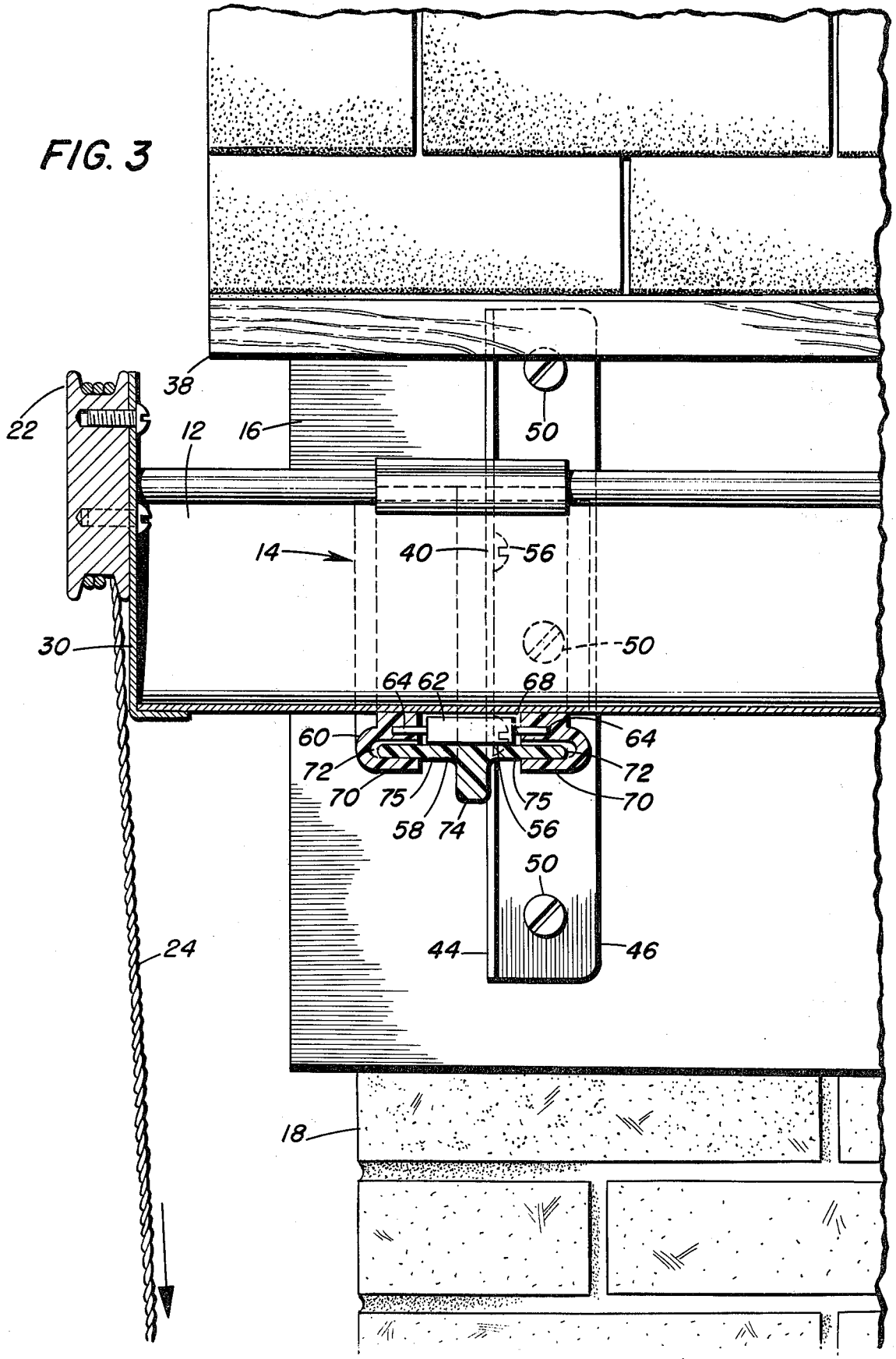
FIG. 3 is a cross-sectional view of the gutter system taken along line 3—3 of FIG. 2.

The details of one of the supports 14 is illustrated in FIGS. 2 and 3. Support 14 includes a support bracket 58 having a generally circular cross-section, when viewed from the side and a support member 60. The support bracket 58 should extend through an arc of sufficient length so that support 14 can hold gutter 12 in a substantially inverted position, for example, through a 270° arc. Support bracket 58 has a generally T-shaped cross-sectional configuration in a longitudinal direction with a stiffening rib 74 and a support arm 75 extending laterally to either side of rib 74. The upper surface of the support arms 75 functions as a bearing surface. In the preferred embodiment, support 14 is made of a plastic material, although any suitable material such as metal may be employed. Support bracket 58 movably holds the gutter support member 60. Gutter support member 60 has a generally circular configuration which mates with the configuration of the support member 58 and extends through a 180° arc. Gutter support member 60 is secured to gutter 12 by flexible rolled edges 66 which snap fit around rolled edges 28 of gutter 12. Other snap fit or clip mechanisms may be used to hold gutters of different configurations. The outer edges of gutter support member 60 form U-shape flanges 70 which define a pair of facing channels 72. One arm 75 of bracket member 58 is received in each channel 72. Support member 60 is thus prevented from moving in a longitudinal direction, while curvilinear motion along the bearing surface of the support arms 75 is permitted.

A plurality of roller bearings 62 are carried by support member 60 to allow it to move freely with respect to support bracket 58. Each roller bearing 62 is received within a slot or gap 68 in the support member 60 and is rotatably held therein by a pin 64. The pin 64 has opposite ends held in apertures of upper portions of facing flanges 70. The diameter of the roller bearing 62 and the location of the axes of the pins 64 are selected so that the roller bearings 62 carry a substantial portion the load between the support bracket 58 and the support member 60. As seen in FIG. 2, roller bearings 62 are in contact with the bearing surface while the facing surfaces of the support bracket 58 and the support member 60 are out of contact. Alternatively, rollers could be supported by the support bracket 58 to thereby form the curvilinear bearing surface thereof.

Downspout assembly 26 includes downspout head 80 having a conventional shape and lower end 82 for mating with a conventional downspout drain tube 84. Downspout head 80 includes a top 86 and a circular opening in one side of downspout head 80 through which the gutter extends. Gutter 12 may be rotated within the circular opening, permitting use of a downspout with the rotating dumpable gutter of the present invention without hindrance from the downspout. It is readily apparent that circular opening may be equipped with roller bearings in a manner similar to support 14, but this is not necessary.

If desired, a screen, not shown, may be attached to the inside of gutter 12, where gutter 12 enters downspout head 80 to prevent debris from entering downspout assembly 26. Location of the screen outside downspout head 80 is necessary to ensure that accumulated debris may be conveniently emptied by rotation of gutter 12.

Supports 14 may be adapted for attachment to buildings having various types of pitched roofs. FIGS. 2 and 5 illustrate two methods of attaching supports 14 to a vertical wall or facia board 16. In FIG. 2 support 14 is comprised of an arm 36 and a mounting piece 44. A plurality of apertures 42 are formed through mounting piece 44 in vertical alignment to permit adjustment of the height of supports 14 and gutter 12. Mounting piece 44 includes a right angle flange 46 having apertures 48 for securing mounting piece 44 to facia board 16 with fasteners, such as wood screws 50. Arm 36 has sufficient length so that support 14 can be attached to facia board 16 and support gutter 12 immediately adjacent the lower roof line 38 of building 18. Arm 36 includes apertures 40 which are aligned with similarly spaced apertures 42 in facia board mounting piece 44. Fasteners 56, such as nuts and bolts, are inserted through aligned holes 40, 42 to secure arm 36 to mounting piece 44. The vertical extent of the mounting piece 44 can be increased and additional rows of holes 42 may be added to make the position of the gutter 12 from the wall 16 further adjustable.

FIG. 5 illustrates a portion of modified gutter system 10'. Elements of system 10' which are similar to elements of system 10 will be indicated by like primed numerals. The support 14' is comprised of a single integral piece of material rather than the two pieces of support 14. The horizontal extent of the support is selected to fit beneath a specified roof overhang. In the particular application shown in FIG. 5, the gutter 12 is held relatively close to the vertical wall of the building due to a short overhang of the roof.

FIG. 6 illustrates a portion of another modified gutter system 10''. Elements of system 10'' which are similar to elements of system 10 will be indicated by like primed numerals. Support bracket 14'' is comprised of two pieces, i.e., an arm 36'' and a mounting piece 44''. However, mounting piece 44'' is attached to the underside of an eave 49 by wood screws 50'' rather than to a vertical wall. Arm 36'' of mounting bracket 14'' includes perpendicular end piece 52 having apertures 54 for securing mounting bracket 14'' substantially parallel to eave 49 to hold supports 14'' and a gutter immediately below the lower roof line of the building. Both the height of support 14'' and its lateral position relative to the roof line are adjustable by selectively aligning two apetures 54 with any two of the plurality of apertures 42'' in mounting piece 44''. Arm 36'' may be secured to mounting piece 44'' by suitable fasteners, such as nuts and bolts 56''.

In operation, gutter 12 is normally in a horizontal rain catching position as illustrated in full line FIG. 2. A coiled spring (not shown) may be aligned along an axis parallel to the longitudinal axis of gutter 12, and have spring arms retained in apertures in support 14 and gutter 12 to bias gutter 12 in its normal upright position. A gutter stop 90, formed by an outer edge of support member 58, prevents rotation of gutter 12 upwardly and inwardly of lower roof line 38. A biasing spring, however, is generally not required because the inherent inertia and friction of the system prevent inadvertant rotation of gutter 12 after it has been properly positioned and cable 24 may be secured under tension to hold gutter 12 in position. When removal of accumulated debris from gutter 12 becomes desirable, an operator standing on the ground removes cable 24 from anchor 34 and pulls on one side of the loop formed by cable 24 to rotate gutter 12 within supports 14 clockwise to the partially inverted position illustrated in phantom line in FIG. 2. By gently banging gutter 12 against the upper portion of roof line 38, most debris are dislodged from the gutter automatically. Debris that adhere to the inner surface of gutter 12 dispite banging may be dislodged with a stream of water from a hose, or an elongated hand tool manipulated by an operator on the ground. For such an operation, maintaining gutter 12 in its substantially inverted debris dislodging position without holding cable 24 is desirable and may be accomplished by retying cable 24 about anchor 34. After debris have been dislodged from gutter 12, the operator merely pulls on the opposite side of the loop formed by cable 24 to return gutter 12 to its normal upright position. Securing cable 24 to anchor 34 holds gutter 12 in its normal upright position.

Although the preferred embodiment described above uses simple hand operated cable and pulley mechanism to rotate gutter 12, it is evident that such rotation be accomplished by automatic mechanical systems, such as electric or hydraulic motors.

While the preferred embodiments of the invention have been illustrated and described, it is to be understood that these are capable of variation and modification by those skilled in the art and that the scope of the invention is not limited to the precise details set forth, but should be determined by the following claims.

I claim:

1. A support for a system for rotatably supporting a gutter comprising:

a support bracket for attachment to a building, said bracket having a curvilinear bearing surface;

a support member for attachment to a gutter, said support member being movably held by said support bracket; and a plurality of discrete roller elements rotatably carried by one of said support brackets and said support member for rolling contact between said support member and said support bracket whereby said support member is movable relative to said bracket to rotate a gutter for the removal of debris.

2. A support for a system for rotatably supporting a gutter comprising:

a support bracket for attachment to a building, said support bracket having a bearing surface defined by a plate having spaced lateral edges, and a curvilinear configuration about the longitudinal direction of a gutter to be supported by the system; and a support member including means for connecting said support member to the gutter and a pair of facing channels, each channel having a curvilinear configuration mating with the curvilinear configuration of said plate and being movably received about one of the lateral edges of said plate whereby said support member is coupled to said support bracket so that relative motion between said member and said bracket is permitted along said curvilinear bearing surface and is prevented along the longitudinal direction of said gutter; and a plurality of discrete rollers rotatably carried by said support member for rolling contact with said bearing surface.

3. A support in accordance with claim 1 or 2 wherein the bearing surface of said support bracket is substantially circular and extends greater than 180° to allow said support member to move therealong to substantially invert a gutter held by it.

4. A support in accordance with claim 3 wherein the bearing surface of said support bracket extends for substantially at least 270°.

5. A support in accordance with claim 1 wherein said support member includes clip means for releaseably holding a gutter and channel means for engaging said support bracket to couple said support member to said support bracket while permitting the motion of said support member along said bearing surface.

6. A support in accordance with claim 5 wherein said support bracket includes a pair of lateral edges and said channel means includes a pair of facing channels each received about one of said lateral edges to prevent the motion of said support member in the longitudinal direction of a gutter.

7. A support in accordance with claim 2 wherein said connecting means includes clip means for releasably holding said gutter.

8. A support in accordance with claim 1 or 2 wherein each roller is carried in a gap in said support member and rotatably held therein in by a pin, said pin holding said roller in a disposition such that said rollers form essentially the entire contact surface of said support member on said bearing surface.

9. A support in accordance with claim 1 or 2 wherein said support bracket includes an arm extending from said bearing surface toward a building and a mounting plate for attachment to the building.

10. A support in accordance with claim 9 wherein said arm and mounting plate are formed integral with one another.

11. A support in accordance with claim 9 wherein said arm and mounting plate are formed as discrete parts and including means for connecting said arm to said mounting plate at any one of a plurality of positions to adjust the position of a gutter held by the support bracket with respect to a roof line.

12. A rotatable gutter system for attachment to a building comprising:

an elongate gutter;

a plurality of supports for rotatably attaching said gutter to a building, each support comprising a support bracket for attachment to a building and a support member connected to said gutter, each of said support members being supported by a respective one of said support brackets for motion relative thereto;

each of said support brackets having a curvilinear bearing surface;

each of said support members having a coupling means for coupling said support member to said support bracket to allow relative motion along the direction of the bearing surface but to prevent motion of said support member along the longitudinal direction of said gutter, and connecting means for connecting said support member to said gutter;

means coupled to said gutter for moving said gutter between a rain catching position and a substantially inverted position; and a plurality of discrete rollers rotatably carried by one of said support bracket and said support member of each of said supports for rolling contact between said support bracket and said support member.

13. A rotatable gutter system for attachment to a building comprising:

an elongate gutter;

a plurality of supports for rotatably attaching said gutter to a building, each support comprising a support bracket for attachment to a building and a support member connected to said gutter, each of said support members being supported by a respective one of said support brackets for motion relative thereto;

each of said support brackets having a bearing surface defined by a plate having spaced lateral edges and curvilinear in configuration about the longitudinal direction of said gutter;

each of said support members including means for connecting said support member to said gutter and a pair of facing channels, each channel having a curvilinear configuration mating with the curvilinear configuration of said plate and being movably received about one of the lateral edges of said plate whereby said support member is coupled to said support bracket so that relative motion between said member and bracket is permitted along said curvilinear bearing surface and is prevented along the longitudinal direction of said gutter; and a plurality of discrete rollers coupled to said gutter for moving said gutter between a rain catching position and a substantially inverted position.

14. A gutter system in accordance with claim 13 including roller means carried by said support members for rolling contact with said bearing surface.

15. A gutter system in accordance with claim 12 or 13 wherein the bearing surface of said support bracket is substantially circular and extends greater than 180° to allow said support member to move therealong to substantially invert said gutter.

16. A gutter system in accordance with claim 15 wherein the bearing surface of said support bracket extends for substantially at least 270°.

17. A gutter system in accordance with claim 12 wherein said connecting means includes clip means for releaseably holding said gutter and channel means for engaging said support bracket to couple said support member to said support bracket while permitting the motion of said support member along said bearing surface.

18. A gutter system in accordance with claim 12 or 13 wherein each roller is carried in a gap in said support member and rotatably held therein by a pin, said pin holding said roller in a disposition such that said rollers form essentially the entire contact surface of said support member on said bearing surface.

19. A gutter system in accordance with claim 12 or 13 wherein each of said support brackets include an arm extending from said bearing surface toward a building and a mounting plate for attachment to the building.

20. A gutter system in accordance with claim 19 wherein said arm and mounting plate are formed integral with one another.

21. A gutter system in accordance with claim 19 wherein said arm and mounting plate are formed as discrete parts and including means for connecting said arm to said mounting plate at any one of a plurality of positions to adjust the position of said gutter held by the support bracket with respect to a roof line.

22. A gutter system in accordance with claim 12 or 13 wherein said means for moving said gutter includes a pulley attached to said gutter and a cable wrapped around said pulley, said cable having a sufficient length to be operated from the ground.

23. A gutter system in accordance with claim 12 or 13 including a downspout having a housing with an aperture in one of its sides for receiving an end of said gutter while permitting the rotation of said gutter.

* * * * *